US011226091B2

(12) United States Patent
Xu

(10) Patent No.: US 11,226,091 B2
(45) Date of Patent: Jan. 18, 2022

(54) WATERPROOF LAMP

(71) Applicant: Xiaojun Xu, Jiangmen (CN)

(72) Inventor: Xiaojun Xu, Jiangmen (CN)

( * ) Notice: Subject to any disclaimer, the term of this patent is extended or adjusted under 35 U.S.C. 154(b) by 0 days.

(21) Appl. No.: 17/168,182

(22) Filed: Feb. 5, 2021

(65) Prior Publication Data

US 2021/0222863 A1 Jul. 22, 2021

Related U.S. Application Data

(63) Continuation-in-part of application No. 16/748,813, filed on Jan. 22, 2020, now abandoned.

(30) Foreign Application Priority Data

Jan. 19, 2020 (CN) ..... 202010062608.2

(51) Int. Cl.
*F21V 31/00* (2006.01)
*F21V 21/002* (2006.01)
*F21V 23/06* (2006.01)
*F21V 17/12* (2006.01)

(52) U.S. Cl.
CPC ..... *F21V 31/005* (2013.01); *F21V 17/12* (2013.01); *F21V 21/002* (2013.01); *F21V 23/06* (2013.01)

(58) Field of Classification Search
CPC ..... F21V 31/005; F21V 17/12; F21V 23/002
See application file for complete search history.

(56) References Cited

U.S. PATENT DOCUMENTS 5,095,250 A * 3/1992 Woodside ..... F21V 19/0005 315/323
5,366,386 A * 11/1994 Liao ..... H01R 4/2406 439/419
5,446,640 A * 8/1995 Lin ..... H01R 12/67 362/407
5,531,411 A * 7/1996 Adams ..... A47G 33/105 248/309.1
5,562,481 A * 10/1996 Myson ..... H01R 33/09 439/419
5,626,415 A * 5/1997 Huang ..... F21V 3/00 362/267
5,681,107 A * 10/1997 Wang ..... F21V 21/002 362/249.01
5,775,933 A * 7/1998 Chen ..... H01R 4/2404 439/419
6,238,062 B1 * 5/2001 Hsu ..... F21V 19/006 362/267

(Continued)

*Primary Examiner* — Bryon T Gyllstrom
*Assistant Examiner* — Christopher E Dunay

(57) ABSTRACT

A waterproof lamp includes a lamp base defining a first chamber and comprising a mounting member received in the first chamber, and a cap threadedly connected to the lamp base. The lamp base defines a first mounting opening and a second mounting opening that both communicate with the first chamber. The mounting member defines a second chamber and includes a first mounting post received in the second chamber. The first mounting post defines at least two mounting holes. The mounting member defines a third mounting opening and a fourth mounting opening that communicate with the second chamber and communicate with the at least two mounting holes through the second chamber, and includes a protection plate covering the third mounting opening and the fourth mounting opening.

10 Claims, 8 Drawing Sheets

(56) References Cited

U.S. PATENT DOCUMENTS

| | | | | |
|---|---|---|---|---|
| 6,367,952 | B1 * | 4/2002 | Gibboney, Jr. | F21V 21/002 362/249.05 |
| 6,648,492 | B1 * | 11/2003 | Shih | F21V 21/092 362/249.01 |
| 6,758,578 | B1 * | 7/2004 | Chou | F21V 17/06 362/391 |
| 6,817,733 | B2 * | 11/2004 | Frei | F21S 6/001 362/238 |
| 8,616,905 | B2 * | 12/2013 | McGregor | H01R 9/031 439/207 |
| 2011/0095020 | A1 * | 4/2011 | Yang | H02G 3/088 220/3.2 |
| 2011/0194292 | A1 * | 8/2011 | Tsai | F21S 4/10 362/311.02 |
| 2015/0233562 | A1 * | 8/2015 | Chiang | F21S 10/06 362/249.06 |

* cited by examiner

WATERPROOF LAMP

CROSS REFERENCE TO RELATED APPLICATIONS

This application is a continuation-in-part of and claims priority from co-pending application Ser. No. 16/748,813, which was filed on Jan. 22, 2020, and claims priority to Chinese Patent Application No. 202010062608.2, filed Jan. 19, 2020. The application is incorporated by reference herein in its entirety.

BACKGROUND

1. Technical Field

The present disclosure generally relates to lighting devices, and particularly to a waterproof lamp.

2. Description of Related Art

Many conventional lighting devices are waterproof. Through plastic injection molding process, a tight connection is formed between the lamp holder and the cables of some conventional lighting devices, which prevents liquid from entering the lamp holder. Although the above-mentioned way for waterproofing can satisfy basic requirements, it is still useful and desirable to provide a new waterproof lamp.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
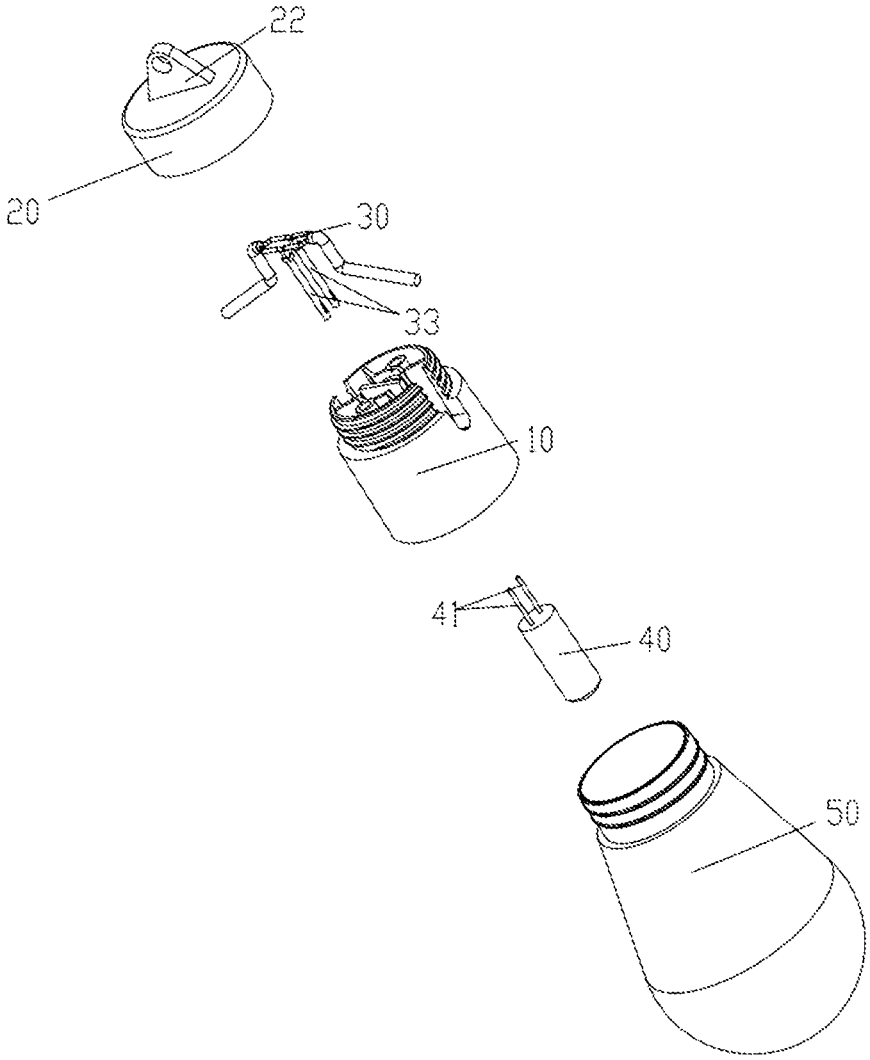
FIG. 1 is a schematic isometric exploded view of a waterproof lamp according to an embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

The terms "upper", "lower", "left" and "right", indicating the orientational or positional relationship based on the orientational or positional relationship shown in the drawings, are merely for convenience of description, but are not intended to indicate or imply that the device or elements must have a particular orientation or be constructed and operated in a particular orientation, and therefore should not be construed as limiting the present invention. The terms "first" and "second" are used for descriptive purposes only and are not to be construed as indicating or implying relative importance or implicitly indicating the number of technical features. The meaning of "multiple" is two or more, unless expressly stated otherwise.

Figure 2:
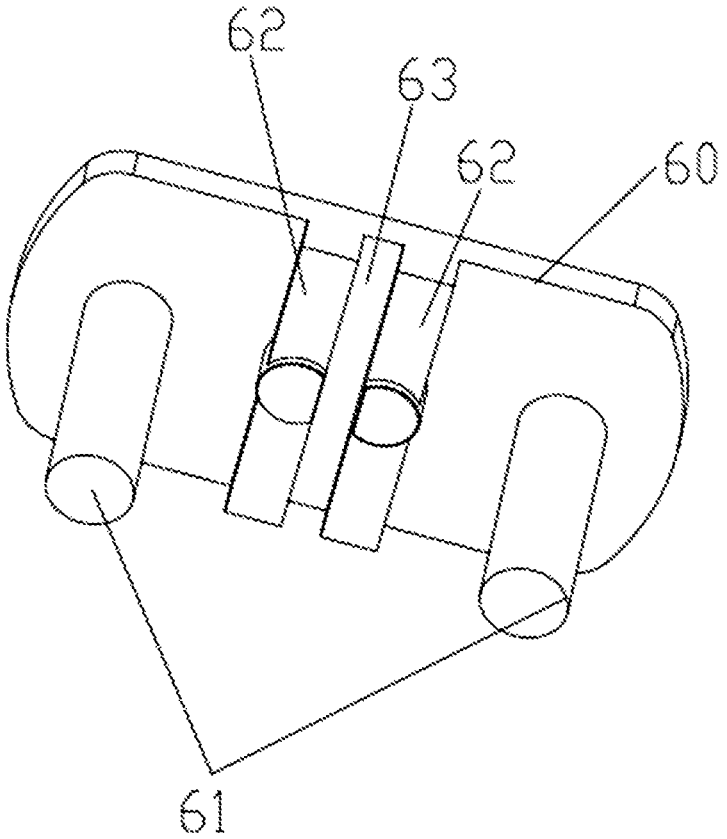
FIG. 2 is an isometric view of a protection plate of the lamp of FIG. 1.
Figure 3:
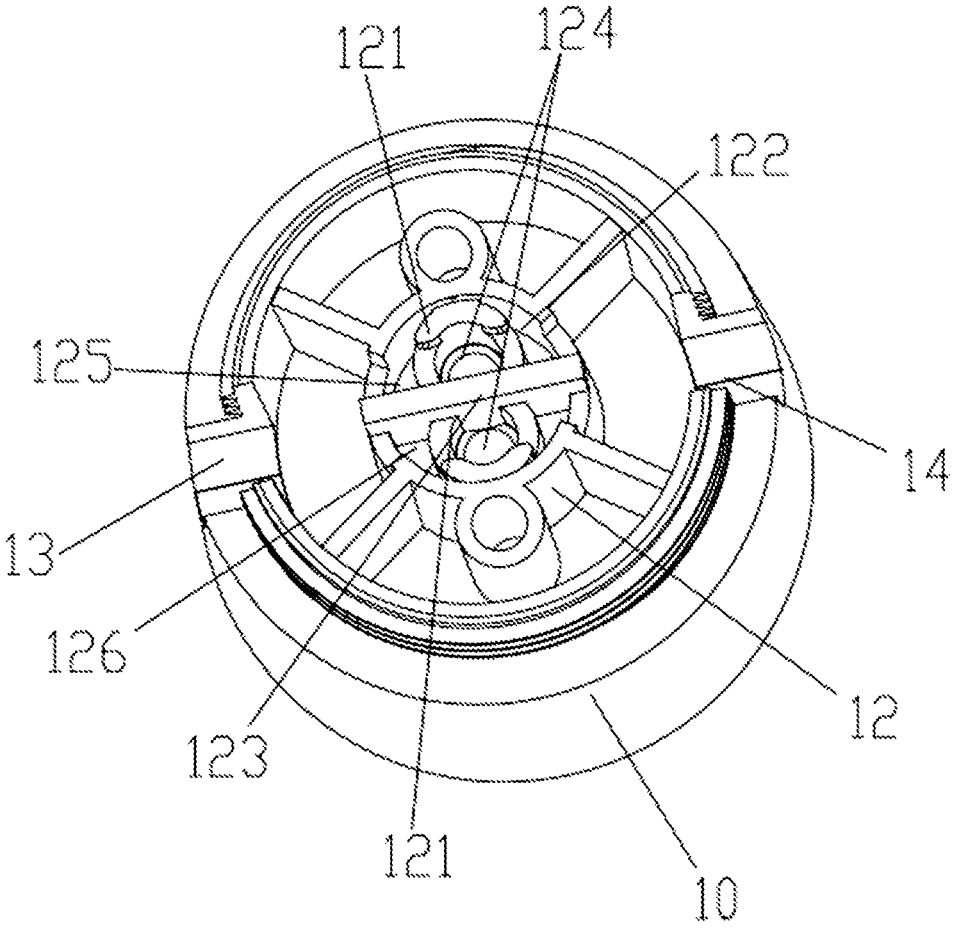
FIG. 3 is an isometric view of a lamp base of the lamp of FIG. 1.
Figure 4:
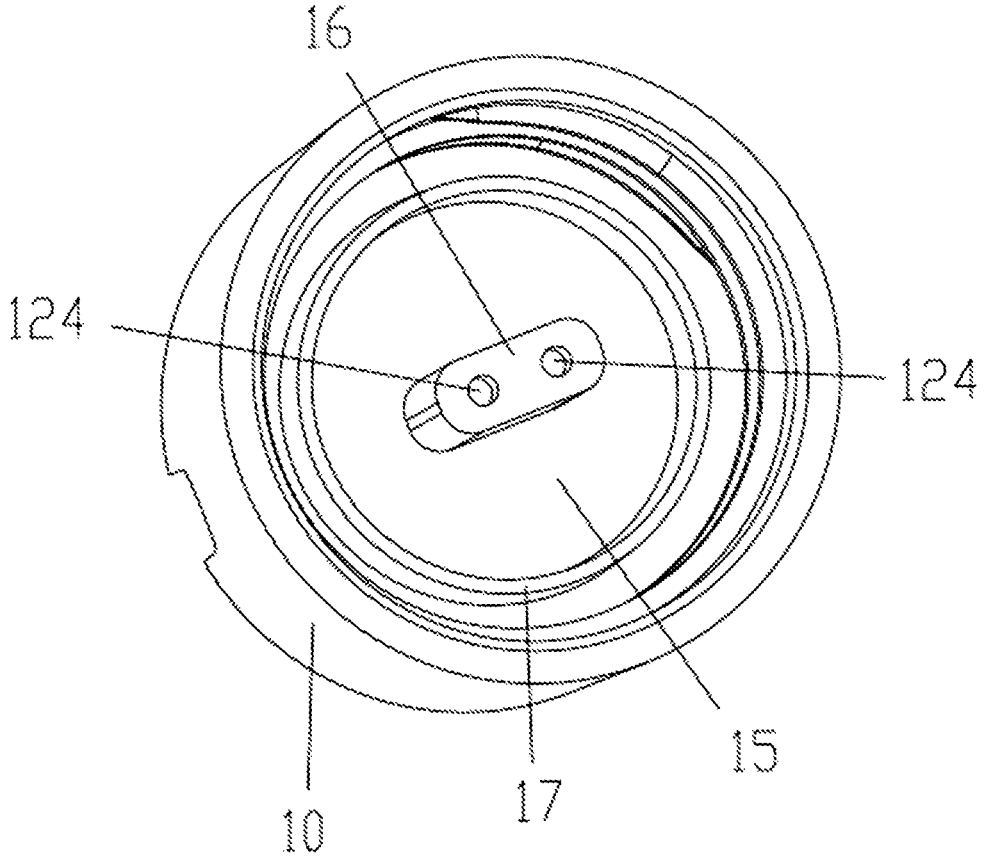
FIG. 4 is an isometric view of the lamp base of the lamp of FIG. 1, viewed from a different perspective.
Figure 5:
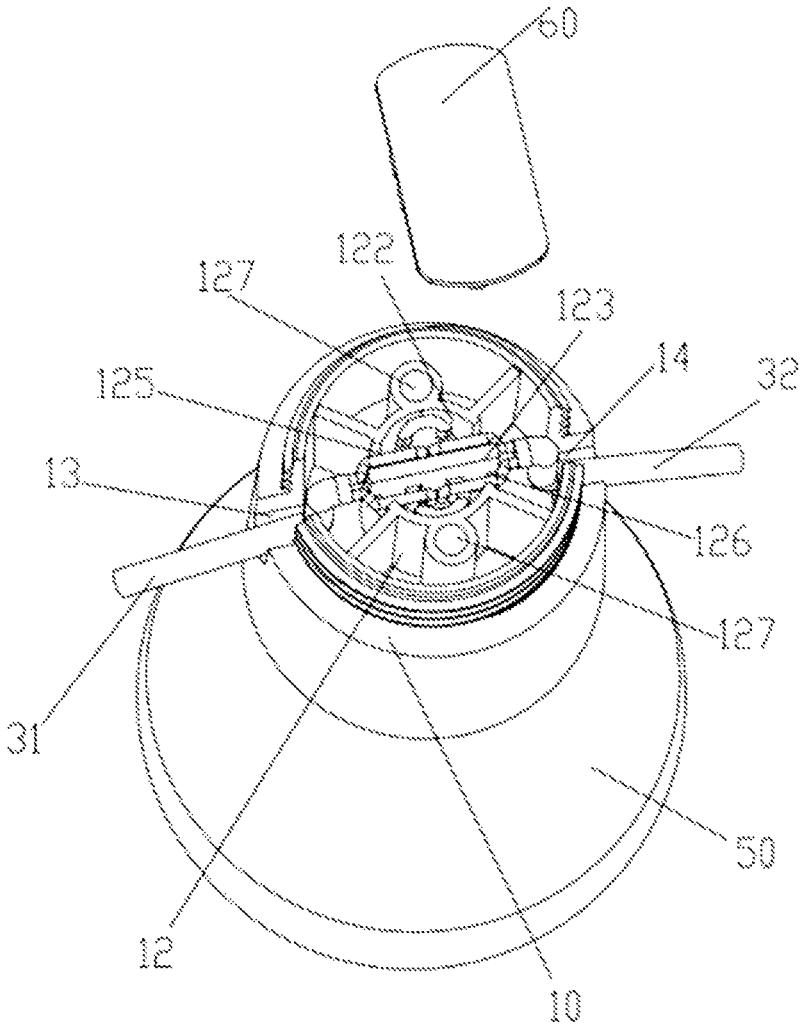
FIG. 5 is an isometric view of the waterproof lamp of FIG. 1, with the cap of FIG. 2 removed and the protection plate of FIG. 2 disengaged from the lamp base.
Figure 6:
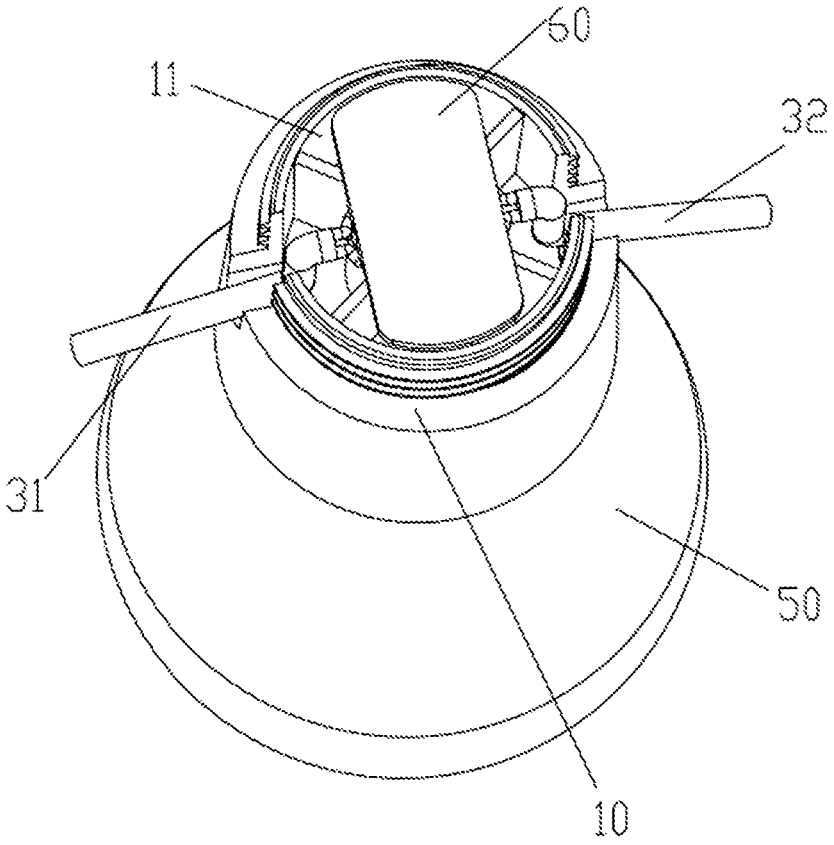
FIG. 6 is similar to FIG. 5, with the protection plate of FIG. 2 mounted to the lamp base.
Figure 7:
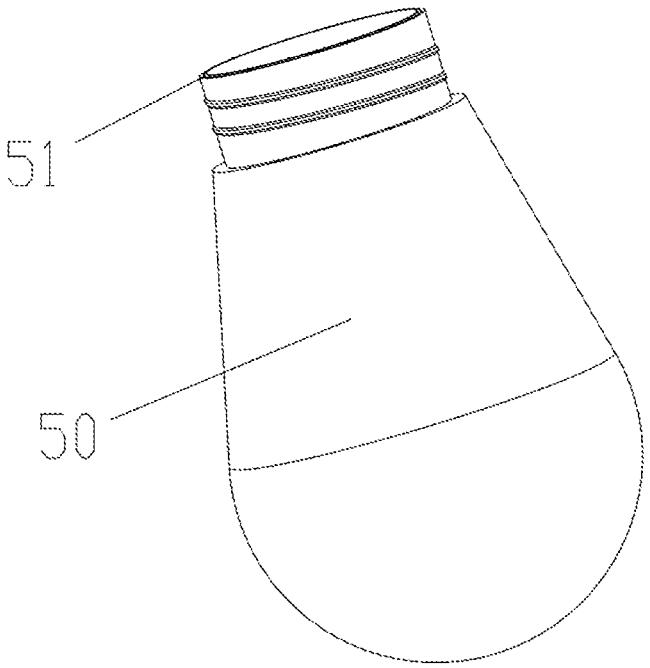
FIG. 7 is an isometric view of a shield of the lamp of FIG. 1.
Figure 8:
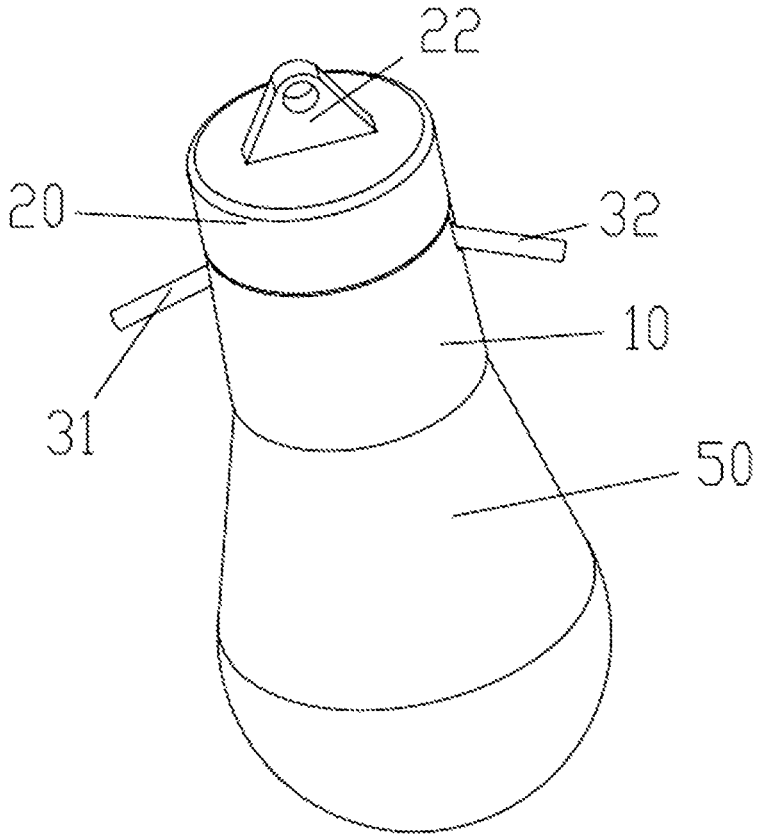
FIG. 8 is an isometric assembled view of the lamp of FIG. 1.

Referring to FIGS. 1-4, in one embodiment, a waterproof lamp includes a lamp base 10 and a cap 20. The lamp base 10 defines a first chamber 11 and a mounting member 12 received in the first chamber 11. The lamp base 10 defines a first mounting opening 13 and a second mounting opening 14 that both communicate with the first chamber 11. The mounting member 12 defines a second chamber 122 and includes a first mounting post 121 received in the second chamber 122. The cap 20 is threadedly connected to the lamp base 10. The mounting member 12 is higher than a bottom of each of the first mounting opening 13 and the second mounting opening 14.

In one embodiment, the mounting member 12 is received in the first chamber 11 and fixed to the lamp base 10. The first mounting post 121 is received in the second chamber 122 and fixed to the mounting member 12. In the embodiment, the lamp base 10 includes a hollow cylindrical portion. The first mounting opening 13 and the second mounting opening 14 extend from the top end of the hollow cylindrical portion and are opposite each other. When liquid enters the first chamber 11, the liquid cannot enter the second chamber 122 because the mounting member 12 is higher than the bottom of the first mounting opening 13 and the second mounting opening 14. The liquid will flow out of the lamp base 10 from the first mounting opening 13 and the second mounting opening 14.

In one embodiment, the mounting member 12 further includes a limiting plate 123 on the first mounting post 121. In the embodiment, the limiting plate 123 is received in the second chamber 122.

In one embodiment, the limiting plates 123 are received in the second chamber 122 and fixed to the first mounting post 121. The lamp base 10 and the cap 20 can be easily connected to each other by thread connection. One or more hooking members 22 may be formed on an end of the cap 20 so as to allow the lamp to be hung on a desired position.

In one embodiment, the lamp base 10 further defines a third chamber 15 and includes a second mounting post 16 received in the third chamber 15. The second mounting post 16 and the first mounting post 121 extend along a same imaginary line. At least two mounting holes 124 extend along the imaginary line and extend through the first mounting post 121 and the second mounting post 16, and communicate with the second chamber 122.

In one embodiment, the first chamber 11 is defined in the top end of the lamp base 10 and the third chamber 15 is defined in the bottom end of the lamp base 10. The second mounting post 16 is received in the third chamber 15 and fixed to the lamp base 10. The second mounting post 16 and the first mounting post 121 extend along the same imaginary line such that the mounting holes 124 can extend from one end of the first mounting post 121 to one end of the second mounting post 16.

In one embodiment, the mounting member 12 defines a third mounting opening 125 and a fourth mounting opening 126 that communicate with the second chamber 122, which enables the third mounting opening 125 and the fourth mounting opening 126 to communicate with two mounting holes 124. The first mounting post 121 is higher than the bottom of each of the third mounting opening 125 and the fourth mounting opening 126.

In the embodiment, the third mounting opening 125 and the fourth mounting opening 126 communicate with the first chamber 11. The bottom of each of the third mounting opening 125 and the fourth mounting opening 126 is higher than the bottom of each of the first mounting opening 13 and the fourth mounting opening 14. When liquid enters the second chamber 122, the liquid cannot enter the mounting holes 124 because the first mounting post 121 is higher than the bottom of each of the third mounting opening 125 and the fourth mounting opening 126. The liquid will flow into the first chamber 11 from the third mounting opening 125 and the fourth mounting opening 126, and then flow out of the lamp base 10 through the first mounting opening 13 and the second mounting opening 14.

In one embodiment, the lamp further includes a cable assembly 30 including a first cable 31, a second cable 32 and two conductive members 33. The first cable 31 and the second cable 32 are both electrically connected to the two conductive members 33. The two conductive members 33 are respectively received in the two mounting holes 124. The first cable 31 passes through the third mounting opening 125 and the first mounting opening 13 and one end of the first cable 31 extends out of the lamp base 10. The second cable 32 passes through the fourth mounting opening 126 and the second mounting opening 14 and one end of the second cable 32 extends out of the lamp base 10.

In the embodiment, no plastic injection molding process is needed for forming sealing between the lamp base 10 and the cables 31 and 32, which facilitates reduction of cost. The first cable 31 passes through the third mounting opening 125 and the fourth mounting opening 126, and extends out of the mounting member 12 through the first mounting opening 13. The second cable 32 passes through the third mounting opening 125 and the fourth mounting opening 126, and extends out of the mounting member 12 through the second mounting opening 14. In this case, the first cable 31 and the second cable 32 do not need to be wound around the mounting member 12. The first cable 31 may include two wires that are separated by the limiting plate 123, and the second cable 32 may include two wires that are separated by the limiting plate 123. Each of the two wires of each of the cables 31 and 32 passes through the third mounting opening 125 and the fourth mounting opening 126. One of the two cables 31 and 32 serves as a power input line and the other serves as a power output line. This arrangement makes it convenient to connect multiple waterproof lamps of the present disclosure in series.

In one embodiment, the mounting member 12 further includes a protection plate 60 that covers the third mounting opening 125 and the fourth mounting opening 126. The protection plate 60 may include one or more positioning posts 61 and the mounting member 12 may define one or more positioning holes 127 to receive the one or more positioning posts 61. In the embodiment, there is one positioning post 61 and one positioning hole 127. The protection plate 60 may further include two parallel limiting protrusions 62 that are respectively received in the third mounting opening 125 and the fourth mounting opening 126. The two limiting protrusions 62 define a positioning groove 63 therebetween. An end of the limiting plate 123 is received in the positioning groove 63.

In one embodiment, in order to obtain the ductility of the first cable 31 and the second cable 32, and to facilitate the installation of the first cable 31 and the second cable 32 in the third mounting opening 125 and the fourth mounting opening 126, the portion of each of the first cable 31 and the second cable 32 received in the third mounting opening 125 and the fourth mounting opening 126 is bare/uncoated. By providing the protection plate 60 covering the third mounting opening 125 and the fourth mounting opening 126, the bare/uncoated portions of the first cables 31 and the second cables 31 in the third mounting opening 125 and the fourth mounting opening 126 are prevented from coming into contact with one another, thereby effectively avoiding the problem of short circuit. Specifically, by the engagement between the positioning post 61 and the positioning hole 127, the protection plate 60 can be accurately positioned above the third mounting opening 125 and the fourth mounting opening 126. When the cap 20 is threadedly connected to the lamp base 10, the cap 20 acts as a limit for the protection plate 60 in the vertical direction to prevent the positioning post 61 from disengaging from the positioning hole 127. The two limiting protrusions 62 are respectively received in the third mounting opening 125 and the fourth mounting opening 126. The two limiting protrusions 62 can prevent the first cable 31 and the second cable 32 from disengaging from the third mounting opening 125 and the fourth mounting opening 126, thereby preventing the first cable 31 and the second cable 32 in the third mounting opening 125 and the fourth mounting opening 126 from coming into contact with each other. The end of the limiting plate 123 is received in the positioning groove 63. On the one hand, such arrangement plays a role of limiting and increases the fixing force between the protection plate 60 and the mounting member. On the other hand, it can seal the space to prevent the third mounting opening 125 and the fourth mounting opening 126 from communicating with each other. The two opposite ends of the protection plate 60 are arc-shaped to fit the inner surface of the first chamber 11. Due to the limiting effect of the protection plate 60 on the first cable 31 and the second cable, the cable assembly 30 can sustain strong pulling force.

In the embodiment, if liquid enters the first chamber 11 through the first cable 31 or the second cable 32, since the mounting member 12 is higher than the bottom of each of the first mounting opening 13 and the second mounting opening 14, the liquid cannot enter the second chamber 122. The liquid will flow out of the lamp base 10 from the first mounting opening 13 and the second mounting opening 14. If liquid enters the second chamber 122 through the first cable 31 or the second cable 32, since the first mounting post 121 is higher than the bottom of each of the third mounting opening 125 and the fourth mounting opening 126, the liquid cannot enter the mounting holes 124 and come into contact with the conductive members 33. The liquid will flow into the first chamber 11 through the third mounting opening 125 and the fourth mounting opening 126, and flow out of the lamp base 10 through the first mounting opening 13 and the second mounting opening 14. As a result, the lamp has good waterproof performance.

In one embodiment, the lamp further includes a light bulb 40 and a shield 50. The light bulb 40 has two pins 41 that are respectively inserted into the two mounting holes 124 and make an electrical connection with the conductive members 33. The light bulb 40 is received in the shield 50 and the shield 50 is threadedly connected to the lamp base 10.

In one embodiment, the lamp further includes a sealing ring 17. The shield 50 includes an annular protrusion 51 on one end thereof. The sealing ring 17 is received in the third chamber 15. The sealing ring 17 is received in the shield 50 and is in tight contact with the shield 50 and the annular protrusion 51 is in tight contact with the lamp base 10 when the shield 50 is connected to the lamp base 10. With such arrangement, a tight connection is formed between the shield 50 and the lamp base 10, which prevents external liquid from entering the shield 50 or the third chamber 15 through the joint where the shield 50 is connected to the lamp base 10.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A waterproof lamp comprising:

a lamp base defining a first chamber and comprising a mounting member received in the first chamber, the lamp base defining a first mounting opening and a second mounting opening that both communicate with the first chamber, the mounting member defining a second chamber and comprising a first mounting post received in the second chamber, the first mounting post defining at least two mounting holes, the mounting member defining a third mounting opening and a fourth mounting opening that communicate with the second chamber and communicate with the at least two mounting holes through the second chamber, and comprising a protection plate covering the third mounting opening and the fourth mounting opening; and a cap threadedly connected to the lamp base.

2. The waterproof lamp according to claim 1, wherein the protection plate comprises a positioning post and the mounting member defines a positioning hole to receive the positioning post.

3. The waterproof lamp according to claim 1, wherein the protection plate comprises two parallel limiting protrusions that are respectively received in the third mounting opening and the fourth mounting opening, the two limiting protrusions define a positioning groove therebetween.

4. The waterproof lamp according to claim 3, wherein the first mounting post comprises a limiting plate that is received in the second chamber, and an end of the limiting plate is received in the positioning groove.

5. The waterproof lamp according to claim 1, wherein the lamp base further defines a third chamber and a second mounting post received in the third chamber, and the second mounting post and the first mounting post extend along a same imaginary line.

6. The waterproof lamp according to claim 5, wherein the at least two mounting holes extend along the imaginary line and extend through the first mounting post and the second mounting post, and communicate with the second chamber.

7. The waterproof lamp according to claim 5, further comprising a sealing ring, wherein the shield comprises an annular protrusion on one end thereof, the sealing ring is received in the third chamber, the sealing ring is received in the shield and is in tight contact with the shield and the annular protrusion is in tight contact with the lamp base when the shield is connected to the lamp base.

8. The waterproof lamp according to claim 1, further comprising a first cable, a second cable and two conductive members, wherein the first cable and the second cable are electrically connected to the two conductive members, the two conductive members are respectively received in the at least two mounting holes, the first cable passes through the third mounting opening, the fourth mounting opening, and the first mounting opening and one end of the first cable extends out of the lamp base, and second cable passes through the third mounting opening, the fourth mounting opening, and the second mounting opening and one end of the second cable extends out of the lamp base.

9. The waterproof lamp according to claim 8, further comprising a light bulb and a shield, wherein the light bulb comprises two pins that are respectively inserted into the at least two mounting holes and make an electrical connection with the conductive members, the light bulb is received in the shield, and the shield is connected to the lamp base.

10. The waterproof lamp according to claim 1, wherein the mounting member is higher than a bottom of each of the first mounting opening and the second mounting opening, the first mounting post is higher than a bottom of each of the third mounting opening and the fourth mounting opening.

* * * * *